US009073202B2

(12) United States Patent
Wang

(10) Patent No.: US 9,073,202 B2
(45) Date of Patent: Jul. 7, 2015

(54) BURGLARPROOF TOOL FITTING HOLDER DEVICE

(71) Applicant: Yeo-Ming Wang, Taipei (TW)

(72) Inventor: Yeo-Ming Wang, Taipei (TW)

( * ) Notice: Subject to any disclaimer, the term of this patent is extended or adjusted under 35 U.S.C. 154(b) by 0 days.

(21) Appl. No.: 14/268,252

(22) Filed: May 2, 2014

(65) Prior Publication Data

US 2014/0238880 A1 Aug. 28, 2014

Related U.S. Application Data

(62) Division of application No. 13/420,049, filed on Mar. 14, 2012, now Pat. No. 8,800,767.

(51) Int. Cl.
*B25H 3/00* (2006.01)
*B25H 3/04* (2006.01)

(52) U.S. Cl.
CPC ... *B25H 3/00* (2013.01); *B25H 3/04* (2013.01)

(58) Field of Classification Search
CPC ..... B25H 3/003; B25H 3/04; B65D 73/0064; B65D 85/20; A47F 5/0006
USPC ..... 206/378, 377, 349, 806, 372; 211/70.6
See application file for complete search history.

(56) References Cited

U.S. PATENT DOCUMENTS 5,740,911 A * 4/1998 Chou ..... 206/378
5,975,297 A 11/1999 Kao
6,076,669 A * 6/2000 Ling ..... 206/349
6,092,656 A * 7/2000 Ernst ..... 206/378
6,241,092 B1 * 6/2001 Vasudeva ..... 206/349
6,415,933 B1 7/2002 Kao
6,508,360 B1 1/2003 Chen
6,669,032 B2 12/2003 Kao
6,698,600 B1 * 3/2004 Lee ..... 211/70.6
6,854,607 B2 2/2005 Tong
6,902,058 B1 * 6/2005 Chang ..... 206/378
7,287,644 B2 * 10/2007 Chen ..... 206/378
7,523,832 B2 4/2009 Kao
8,307,980 B1 11/2012 Kao
8,317,021 B2 11/2012 Christopher
8,376,153 B1 * 2/2013 Lee ..... 211/70.6
8,381,905 B1 2/2013 Kao
8,387,792 B2 3/2013 Chen
8,646,602 B2 * 2/2014 Wang ..... 206/377
2003/0024837 A1 2/2003 Chen
2003/0070999 A1 * 4/2003 Kao ..... 211/70.6
2003/0102275 A1 6/2003 Kao
2005/0121344 A1 * 6/2005 Chang ..... 206/378
2009/0145865 A1 6/2009 Yu
2010/0170817 A1 7/2010 Wu
2014/0084128 A1 3/2014 Chang

* cited by examiner

*Primary Examiner* — Steven A. Reynolds
(74) *Attorney, Agent, or Firm* — Muncy, Geissler, Olds & Lowe, P.C.

(57) ABSTRACT

A burglarproof tool fitting holder device is formed with a side latch to tightly fasten a tool fitting for the effects of hanging show and protection against burglars. The device includes a tool fitting holder body and a burglarproof fixture unit. When the tool fitting holder body combines with the tool fitting in one, the fixing pedestal combines with the fixing cover plate of fixture unit in one via the two sides of the tool fitting to fasten the tool fitting. Further, ribs added in the inner fringes of the fixing cover plate and fixing pedestal is exactly wedged into the groove on the side of tool fitting to secure the tool fitting between the fixing cover plate and the fixing pedestal for effective protection against burglars.

4 Claims, 9 Drawing Sheets

BURGLARPROOF TOOL FITTING HOLDER DEVICE

CROSS REFERENCE TO RELATED APPLICATIONS

This application is a Divisional of co-pending application Ser. No. 13/420,049, filed on Mar. 14, 2012, for which priority is claimed under 35 U.S.C. §120 and the entire contents of which are hereby incorporated by reference.

BACKGROUND OF THE INVENTION

1. Field of the Invention

This invention relates to a burglarproof tool fitting holder device and particularly to a holder device that may easily hold and hang one or more tool fittings for a show.

2. Description of the Related Art

Since ancient times, mechanical engineering has been the driving force for the development of civilization. From the early agricultural era to the era of high technology, small daily necessities, big trains, planes and the like must rely on the machinery for mass production. For example, both traditional and high-tech machinery will use a large number of different sizes of bolts, screws, and nuts as fixing screw components. In the field of mechanical engineering, hand tools operating for the fixing screw components are necessities indispensable.

With reference to FIG. 1, a sleeve, for example, is most commonly used for the hand tools. One end of the sleeve 3 is a joint end 31 of official dimensions, which is used to join a wrench, such as a ratchet wrench, a torque wrench, not shown in the figure; the other end of the sleeve is a forcing end 32, which is used to join a fixing screw component, such as a screw bolt, a screw nut and the like, to be spirally tightened or loosen. However, there are many sizes and shapes of fixing screw components. Thus, in commercially available sleeve group, many sleeves of different sizes and shapes, such as hexagon screws or star screws must be provided to meet the actual demand.

There are many types, sizes, and brands of commercially available sleeves, so sellers always hang single-piece sleeves or the whole group of sleeves for a show for users' selection and purchase. A conventional single-piece sleeve is hanged mainly with a joint pillar 10 and a fixture part 11. The upper end of the joint pillar 10 may be connected to a hand plate 101, while the lower end of the joint pillar 10 is formed with an elastic wedge hook 102. At the time of assembly, the wedge hook 102 is inserted into one end (the joint end 31 or the forcing end 32) of the sleeve 3 and then the fixture part 11 is made to wedge into the wedge hook 12 from the other end of the sleeve 3; such that being not worry about the wedge hook 12 will come off the sleeve 3 inversely.

With reference to FIG. 2, the conventional multi-piece sleeve hanging device is provided with a boom 20, a hanging block 21 for multiple pieces to glide along the boom, and a positioning post 22. Each hanging block 21 combines with each sleeve 3. One end of the boom 20 is formed with a suspension portion, such as a suspension hole, while the other end is a free end 201. The hanging block 21 is inserted into the boom 20 from the free end 201 and may freely glide along the boom 20. At the time of assembly, for combination with the sleeve 3 in one, the hanging blocks 21 glides in along the boom 20 in order. Then, the positioning post 22 is plugged into the free end 201 of the boom 20; such that being not worry about the hanging block 21 will glide out of the boom 20.

Regardless of the hanging device for the single-piece sleeve or multi-piece sleeves, although the sleeve may be hanged for the show, in case of long-term use, it will be unserviceable.

1. For the single-piece hanging device, a combining pillar and a fixture unit are used for merely a tunneling sleeve, of which the joint end communicates with the forcing end. They are not available for the non-tunneling sleeve 3 at all.

2. For the multi-piece hanging device, the free end 201 of the boom 20 works with only the positioning post 22 to prevent the hanging block 21 from unexpectedly gliding out of the boom 20, but it is provided without any fixture device so as to make the total weight of multiple hanging blocks 21 and sleeves 3, when being hanged along the boom 20 for the show, all falls on the positioning post 22, causing the positioning post 22 cannot bear the weight and then unexpectedly coming off the boom 20, and further making the hanging block 21 and the sleeve 3 to glide out of the boom 20 unexpectedly.

Accordingly, to improve the tool fitting holder device for easily securing and hanging the tool fittings for the show and the burglarproof purpose is the goal to achieve in this invention.

Consequently, because of the technical defects of described above, the applicant keeps on carving unflaggingly through wholehearted experience and research to develop the present invention, which can effectively improve the defects described above.

SUMMARY OF THE INVENTION

This invention is mainly to provide a burglarproof tool fitting holder device, in which a side latch is used to tightly fasten a single-piece tool fitting for a hang show and a burglarproof effect, and the tool fitting has a joint end comprises a tool fitting holder body and a fixture unit.

The tool fitting holder body is formed with a lower portion that has a joint part connecting to the tool fitting. The fixture unit is provided at the lower portion of the body to fasten the side of the tool fitting. The fixture unit further comprises a fixing cover plate and a fixing pedestal.

The fixing cover plate is opposite to the side of joint part. The fixing pedestal is provided with a fixing space. The fixing space combines with the fixing cover plate in one at the two sides of the tool fitting to fasten the tool fitting. At least a rib is formed in inner fringes of the fixing space. When the fixing cover plate combines with the fixing pedestal, the rib is wedged into the inside of the groove on the side of the tool fitting.

Thus, the double effects of tool fitting hanging show and protection against burglars may be attained.

Regarding the main feature, a rib is formed in the fixing cover plate opposite inner fringe of the fixing space, wherein the rib embedded inside the groove on the side of the tool parts when the fixing cover plate combines with the fixing pedestal.

Regarding the main feature, at least one ear is formed at each of the two sides of fixing cover plate to combine with the two sides of the fixing pedestal in one.

This invention is further to provide a burglarproof tool fitting holder device, in which a side latch is used to tightly fasten a multi-piece tool fitting for a hang show and a burglarproof effect, and the holder device comprises a tool fitting holder body and a fixture unit.

At least one side of the tool fitting holder body is formed with a track. Along the track, multiple joint parts connecting to the tool fitting are fixed equidistantly. The fixture unit is used to fasten the side of the multi-piece tool fitting. The fixture unit further comprises a fixing cover plate and a fixing pedestal.

The fixing cover plate is provided at one side of the body and stays opposite to the side of joint part. The fixing pedestal is provided at the other side of the body and formed with multiple fixing spaces arranged in order. The fixing space is formed with a separator. The fixing pedestal and the fixing cover plate combine with each other via the two sides of the tool fitting and fasten the tool fitting. Further, at least one rib is formed in the two opposite inner fringes of the fixing cover plate and fixing space to wedge to the groove on the side of the tool fitting.

Thus, the double effects of tool fitting hanging and protection against burglars may be attained.

As described above for the main feature, any of the ends of the track is formed with at least one notch. The upper end of joint part is formed with a portion where the end wedges and glides into the track from the notch.

As described above for the main feature, the track is a T-shaped cross section. The notch is an I-shaped cross section. The track may further comprise a sealing part. The sealing part and the notch of I-shaped cross section combine with each other and thus a T-shaped cross section is formed to seal the notch.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
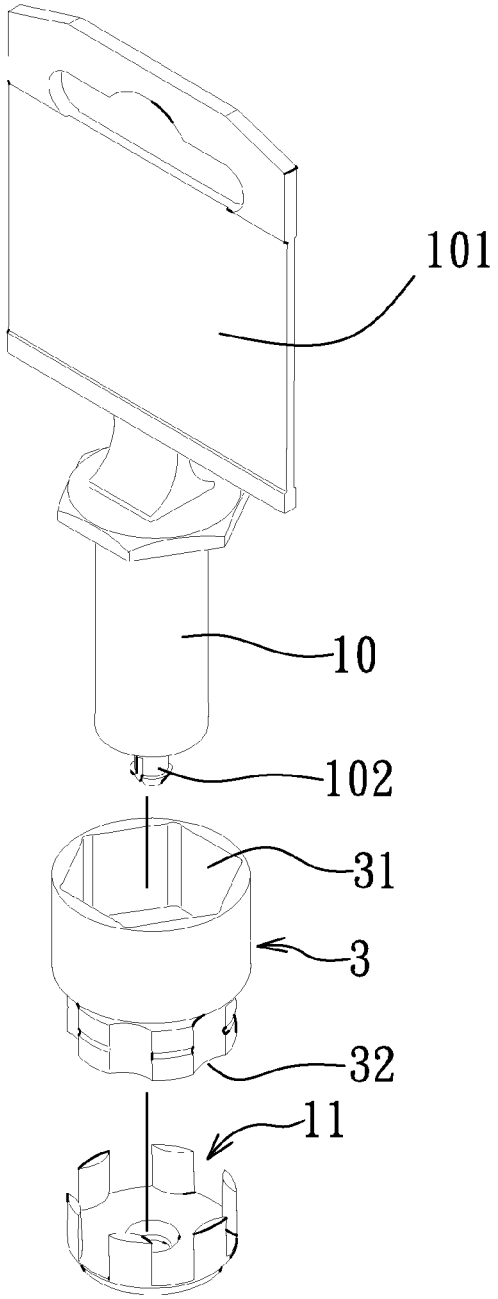
FIG. 1 ( Prior Art )
FIG. 1 is a 3D schematic view illustrating a conventional single-piece sleeve.
Figure 2:
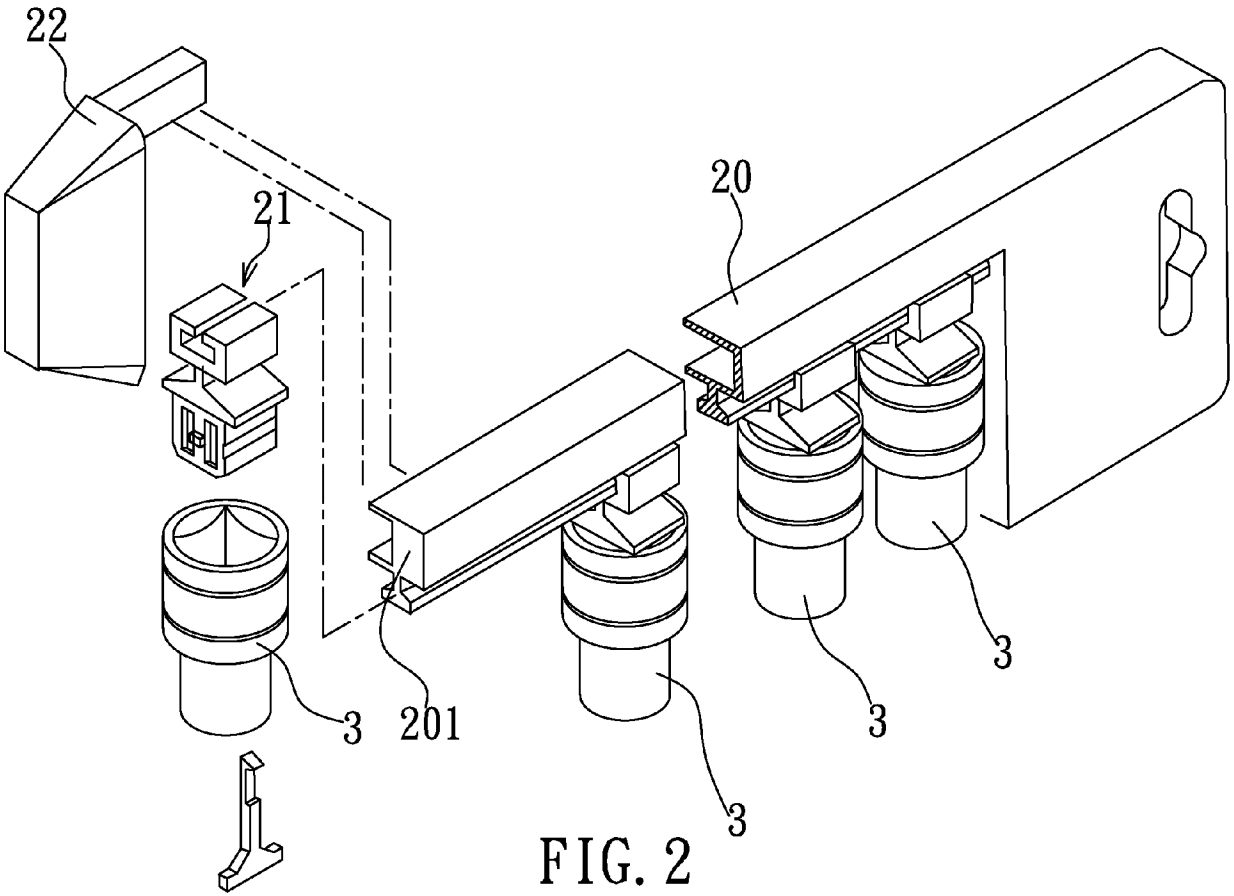
FIG. 2 ( Prior Art )
FIG. 2 is a 3D schematic view illustrating a conventional multi-piece sleeve.
Figure 3:
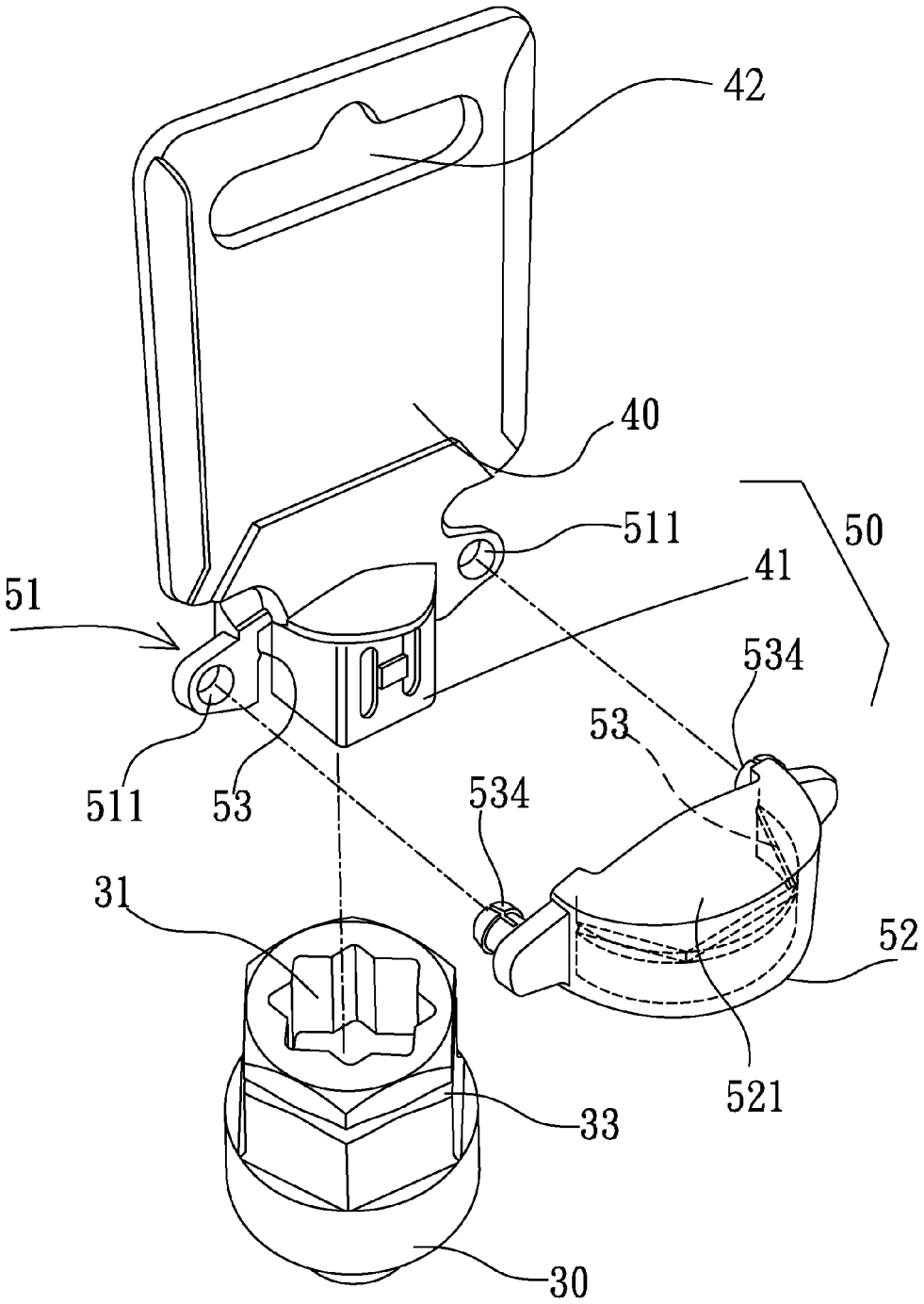
FIG. 3 is a 3D exploded view of a first embodiment of this invention.
Figure 3A:
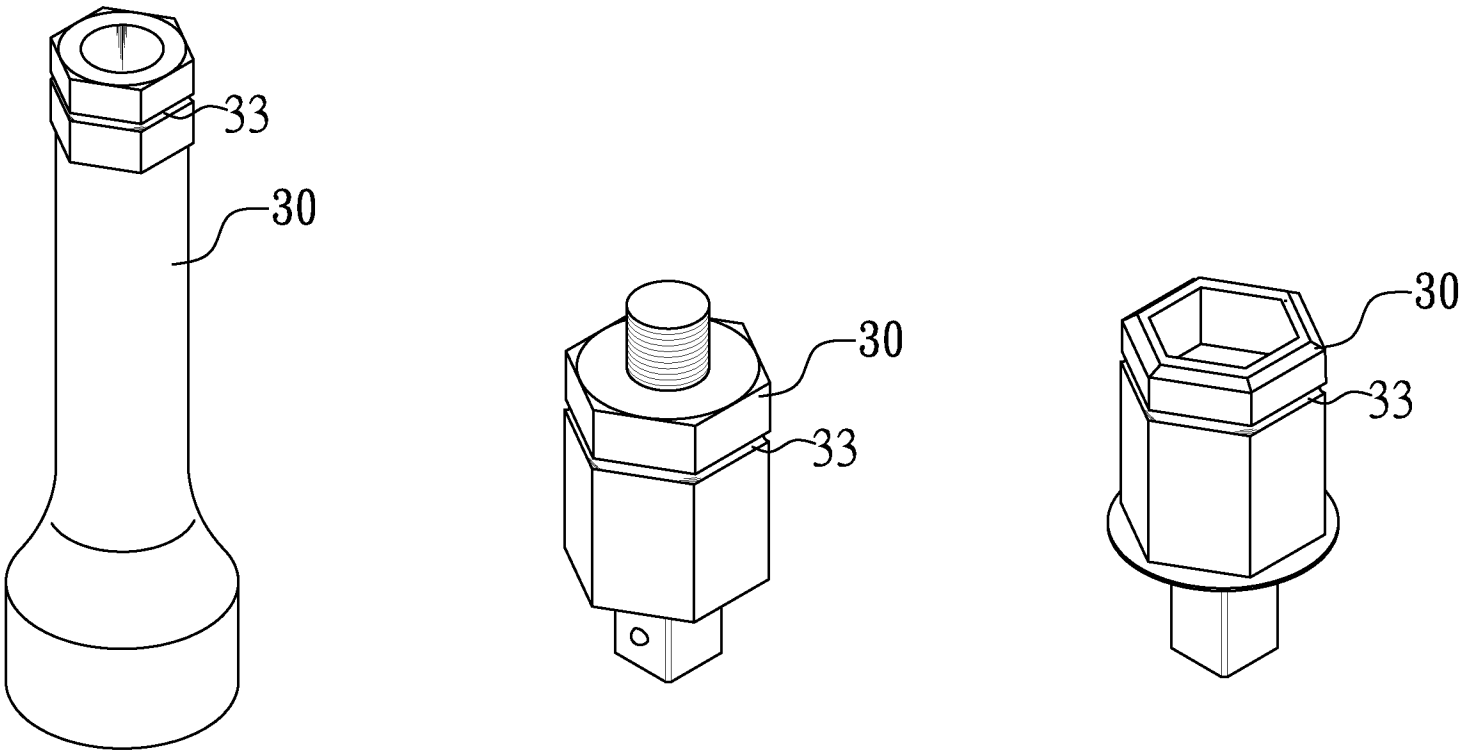
FIG. 3*a* is a schematic view illustrating different tool fittings in the first embodiment of this invention.

A tool fitting 30 according to this invention is not limited to a sleeve and may also be used for a connecting rod, a quick-off plug, or a hexagonal screw split plug, as shown in FIG. 3*a*. An annular groove 33 slightly shrinking is formed at a side of the tool fitting, the side being close to a joint end. This invention is not limit to the statement herein.

Refer to FIG. 3 as a 3D exploded view illustrating a tool fitting holder device in a first embodiment of this invention and illustrating that this invention is applied to a single-piece sleeve.

As shown in the figure illustrating the first embodiment of this invention, a burglarproof tool fitting holder device is provided. In this embodiment, a sleeve is an example. However, the illustration is not limited to this invention. The single-piece sleeve 30 is effectively fastened for the double effects of hanging show and protection against burglars. The device comprises a tool fitting holder body 40 and a fixture unit 50. The more detailed description is made below.

A suspension hole 42 is formed on the tool fitting holder body 40, as shown in FIG. 3. A joint part 41 is provided at the lower portion of the body 40. The joint part 41 combines with the joint end 31 of the sleeve 30.

The fixture unit 50 is provided at the lower portion of the tool fitting holder body 40 and stays opposite to the periphery of joint end 31. In this invention, the fixture unit 50 is used to fasten the single-piece sleeve 30. The fixture unit 50 further comprises a fixing cover plate 51 connecting to the tool fitting holder body 40, and a fixing pedestal 52. The fixing pedestal 52 combines with the fixing cover plate 51 in one respectively via the two sides of the sleeve 30, as shown in FIG. 3, to fasten the sleeve 30. Besides, a fixing space 521 is formed in the fixing pedestal 52. In this embodiment, the fixing space 521 is a concave. Further, at least a rib 53 is formed in the fixing space 521 opposite inner fringe of the fixing cover plate 51. When the fixing cover plate 51 combines with the fixing pedestal 52, the rib 53 formed in the inner fringes of the fixing space 521 may exactly wedged into the groove 33 of the sleeve 30 for the effect of protection against burglars and the effect of hanging and fastening of the sleeve 30.

In order to improve better effect of protection against burglars and the effect of hanging and fastening of the sleeve 30, a rib 53 formed in the fixing cover plate 51 opposite inner fringe of the fixing space 521 of the fixing pedestal 52.

Besides, in this embodiment, the fixing cover plate 51 combines with the tool fitting holder body 40 in one. At least an ear 511 is formed at each of the two sides of fixing cover plate 51. An elastic wedge 534 is formed at each of the two sides of fixing pedestal 52, and the two sides being respectively opposite to the ears 511. When the fixing cover plate 51 combines with the fixing pedestal 52, the elastic wedges 534 are respectively inserted into the opposite ears 511. Thus, the fixing unit 50 may keep on fastening the sleeve 30.

Figure 4:
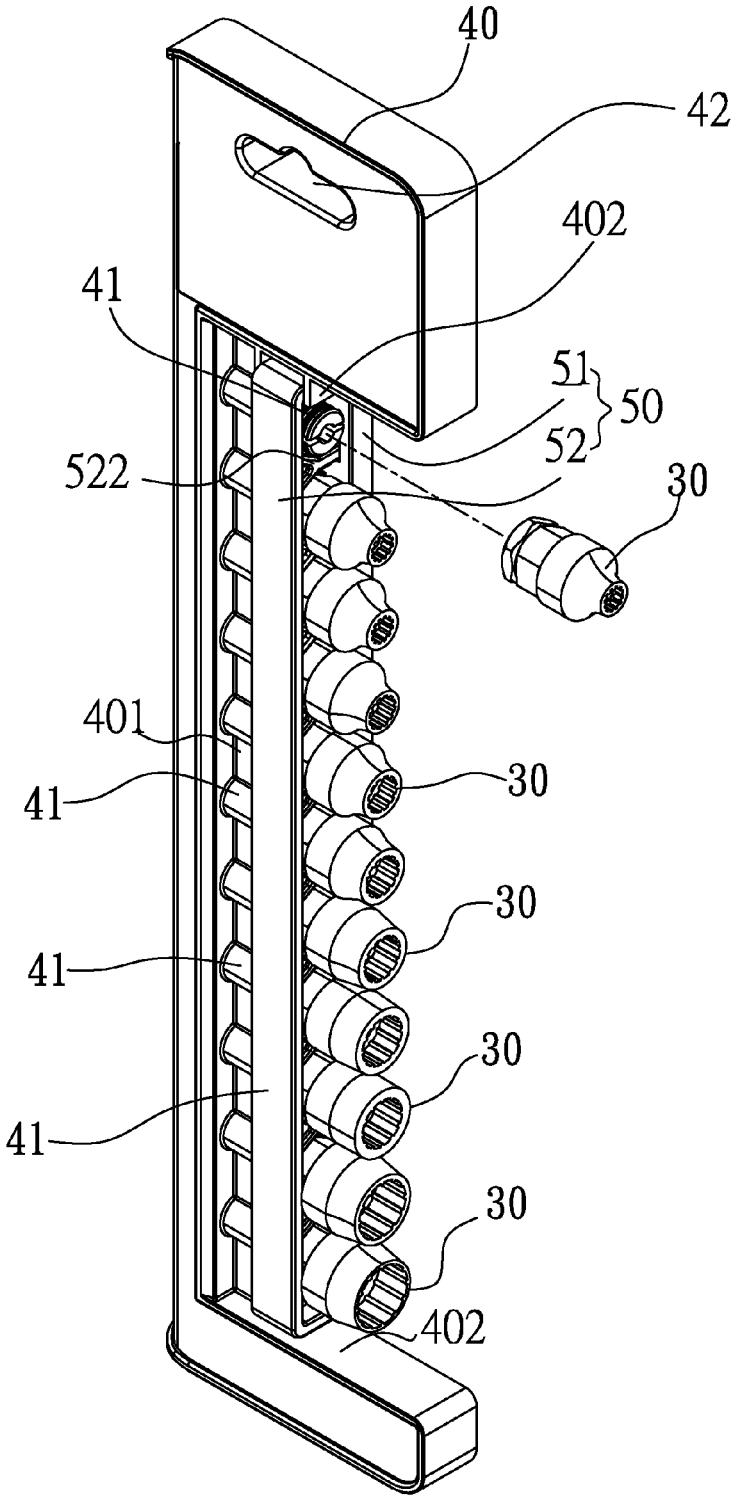
FIG. 4 is a 3D assembly view of a second embodiment of this invention.
Figure 5:
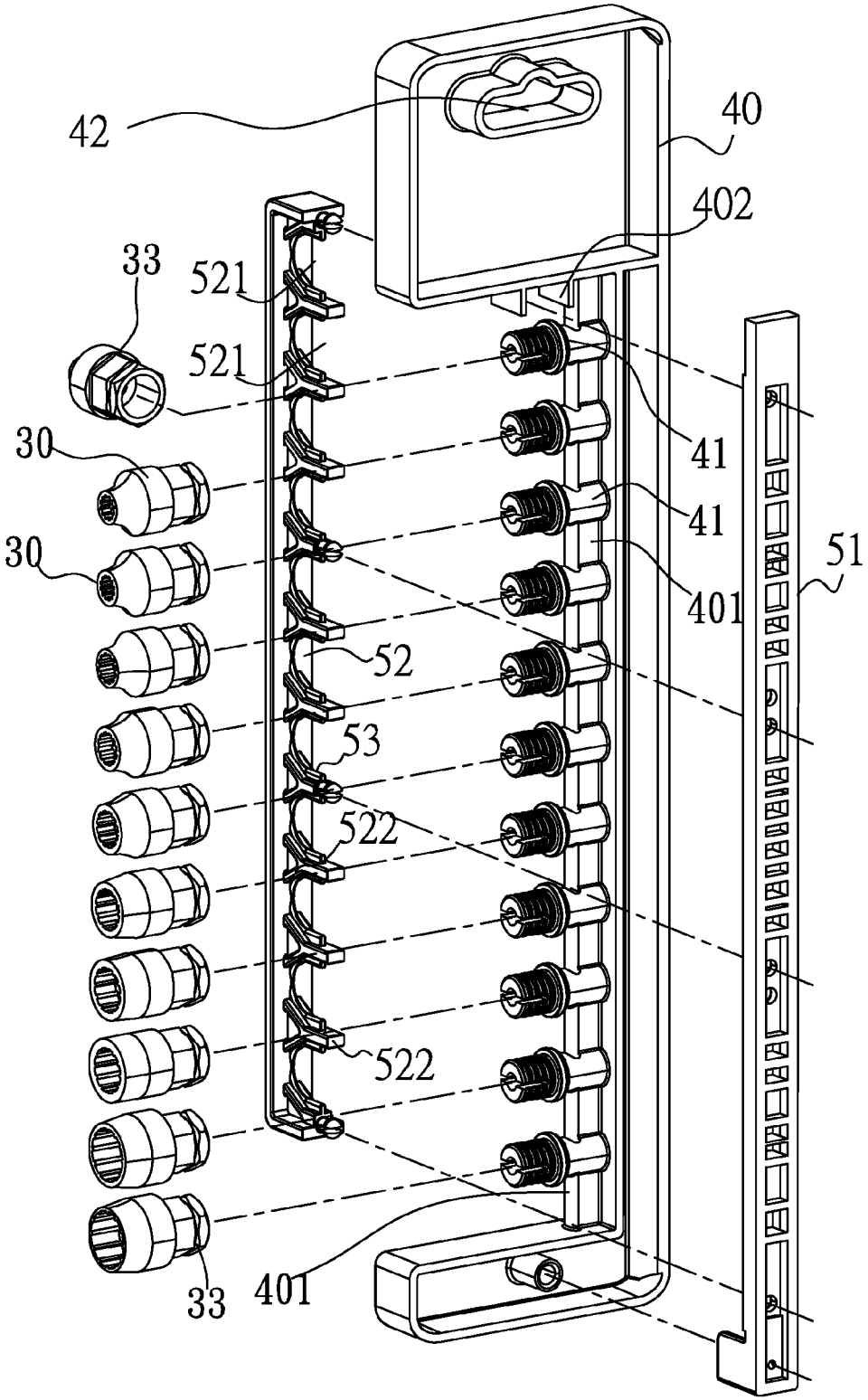
FIG. 5 is a 3D exploded view of the second embodiment of this invention.
Figure 7:
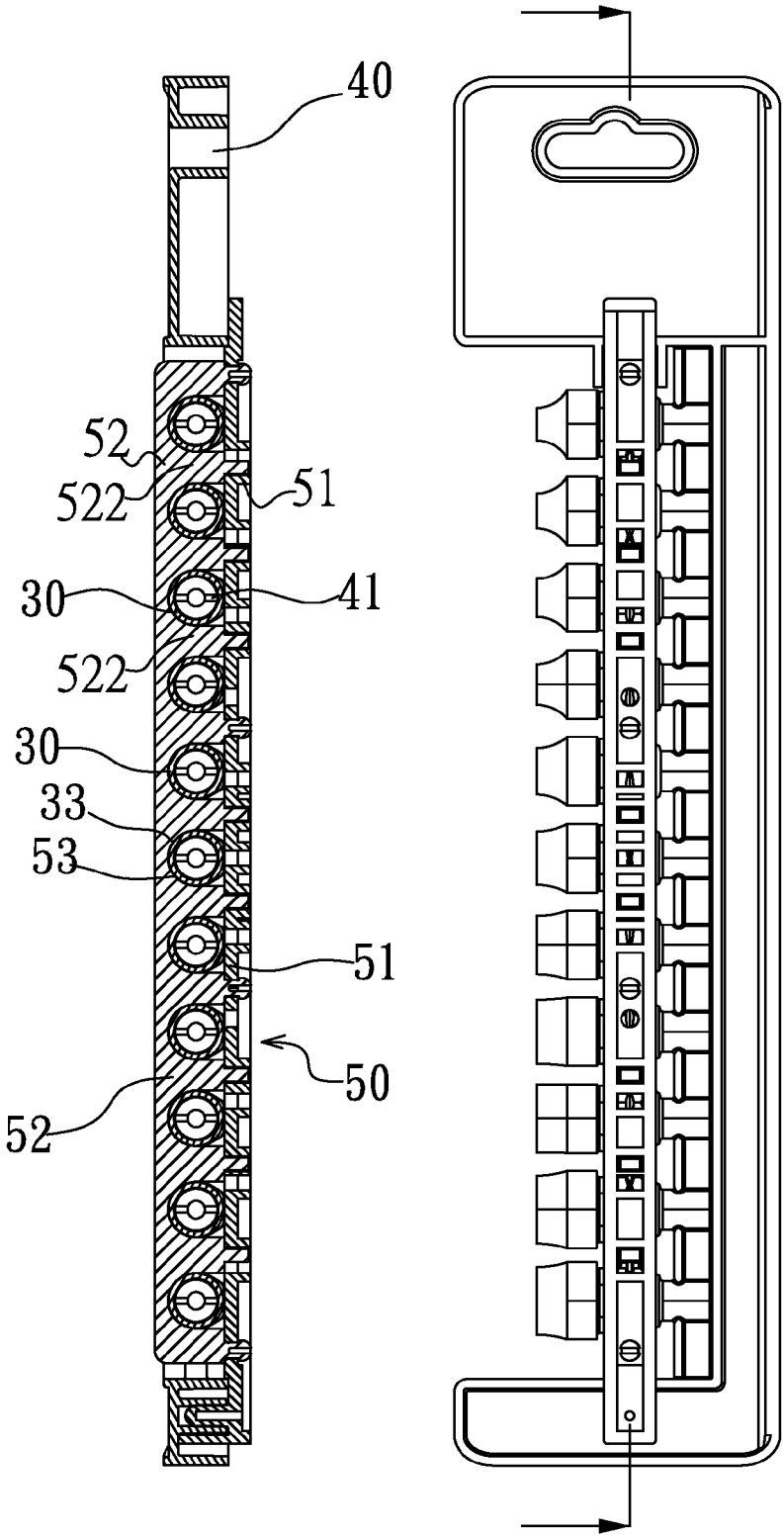
FIG. 7 is a schematic sectional assembly view of the second embodiment of this invention.
Figure 8:
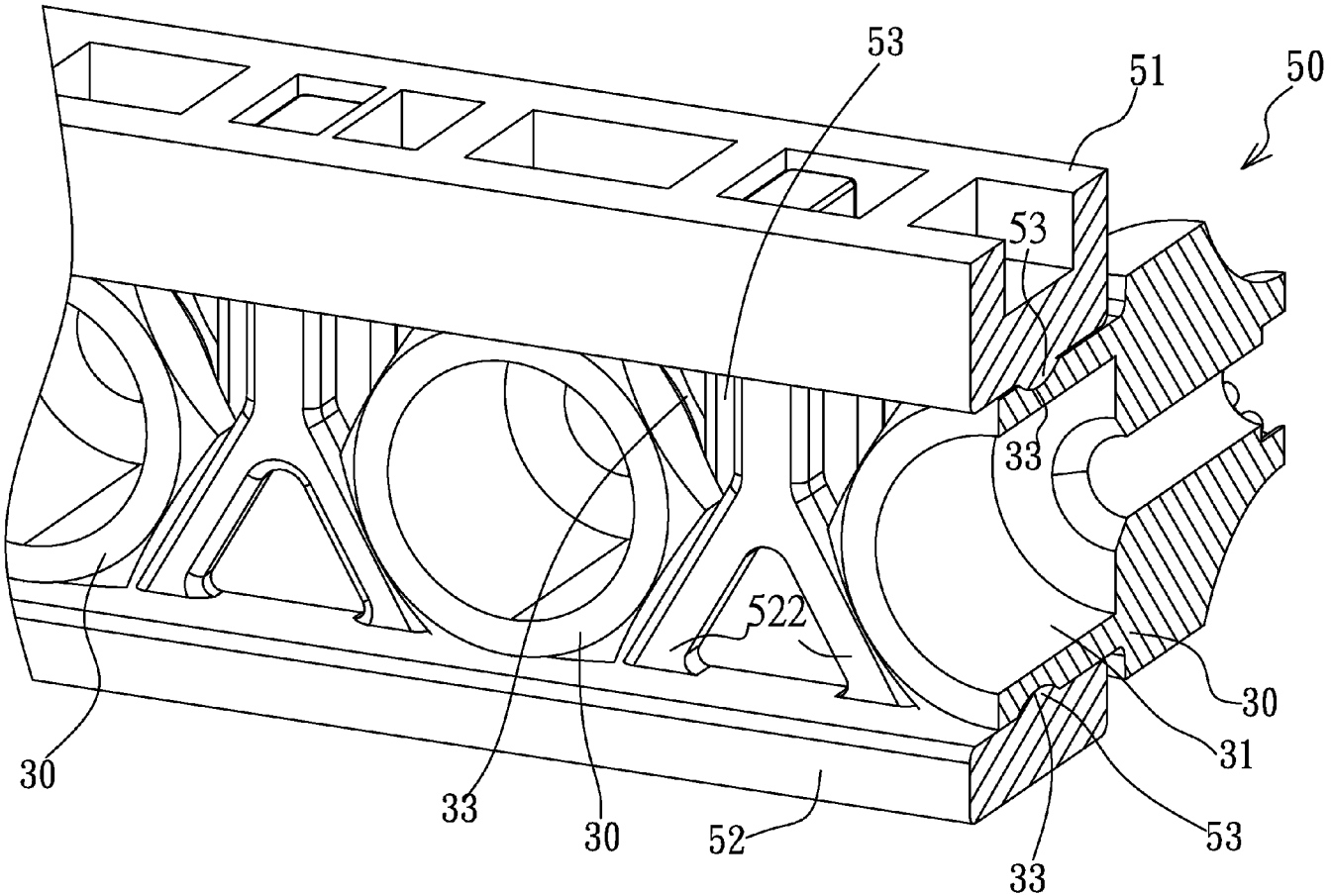
FIG. 8 is a 3D schematic assembly view of the second embodiment of this invention.

Refer to FIGS. 4, 5, 7, and 8. FIG. 4 is a 3D assembly view illustrating the tool fitting holder in a second embodiment of this invention. FIG. 5 is a 3D exploded view illustrating the tool fitting holder in the second embodiment of this invention. FIG. 7 is a schematic sectional assembly view illustrating the tool fitting holder in the second embodiment of this invention. FIG. 8 is a 3D schematic assembly view of the second embodiment of this invention, which illustrates the state of limitation to the joint portion of tool fitting after limiting pedestal, connects to the limiting cover plate.

Refer to the figure illustrating the burglarproof tool fitting holder device in the second embodiment of this invention. In this embodiment, the sleeve is also used as an example, in which multiple sleeves 30 are together fastened for the double effects of hanging show and protection against burglars. The device comprises a tool fitting holder body 40 and a fixture unit 50.

At least one side of the tool fitting holder body 40 is formed with a track 401. Along the track 401, multiple joint parts 41 are provided and arranged equidistantly or un-equidistantly. Further, the track 401 and the joint parts 41 may be formed all in one by injection molding to decrease the cost of assembly. The joint part 41 must match with the joint end 31 of the sleeve 30.

The fixture unit 50 is provided at the periphery opposite to the joint end 31. In this embodiment, the fixture unit 50 may be used to fasten the multi-piece sleeve 30. The fixture unit 50 further comprises a fixing cover plate 51 and a fixing pedestal 52. The fixing pedestal 52 combines with the fixing cover plate 51 in one respectively via the two sides of the sleeve 30, as shown in FIG. 4, to fasten the sleeve 30. In this embodiment, one portion of the fixture unit 50 is fixed onto a joint pillar 402 at one side of the tool fitting holder body 40, in which the joint pillars are flakes parallel to each other, as shown in FIG. 5, and the other portion is connected without limit to this invention. In the fixing pedestal 52, multiple fixing spaces 521 continuously arranged are formed. The fixing space 521 is formed with a separator 522. In this embodiment, the fixing space 521 is a concave. Further, at least one rib 53 is formed in the two opposite inner fringes of the fixing cover plate 51 and the fixing space 521 of fixing pedestal 52, as shown in FIG. 5. Further, the separator 522 is formed with an end protruding towards the fixing cover plate 51, in which the protruding end is inserted into a side of the opposite sleeve 30 to connect to the fixing cover plate 51, as shown in FIGS. 7 and 8; in this embodiment, an opening is formed on the fixing cover plate for the separator to be inserted into the opening. Besides, a rib 53 is formed at the outside of separator 522. As shown in FIG. 5*t*, when the limiting pedestal 52 and the fixing cover plate 51 combine with each other in one via the two sides of sleeve 50, the ribs 53 formed in the fixing space 521 and at the side of separator 522 are together wedged into a groove 33 at the side of sleeve 30, as shown in FIG. 8. Thus, the sleeves 30 cannot be easily taken out of the tool fitting holder body 40 and protected against burglars.

Besides, in this invention, a rib 53 may be likewise formed at the inner side of fixing cover plate 51, namely the groove 33 opposite to the side of sleeve 30, as shown in FIG. 8. Further, the shape of rib 53 also matches with the shape of cross section formed by the groove 33 of sleeve 30. Thus, when the fixing cover plate 51 combines with the fixing pedestal 52, the rib 53 of the fixing pedestal 52 may be wedged to the groove 33 of the side of sleeve 30 and the rib 53 of the fixing cover plate 51 may be also wedged to the groove 33 of the sleeve 30 for better effect of protection against burglars.

Figure 6:
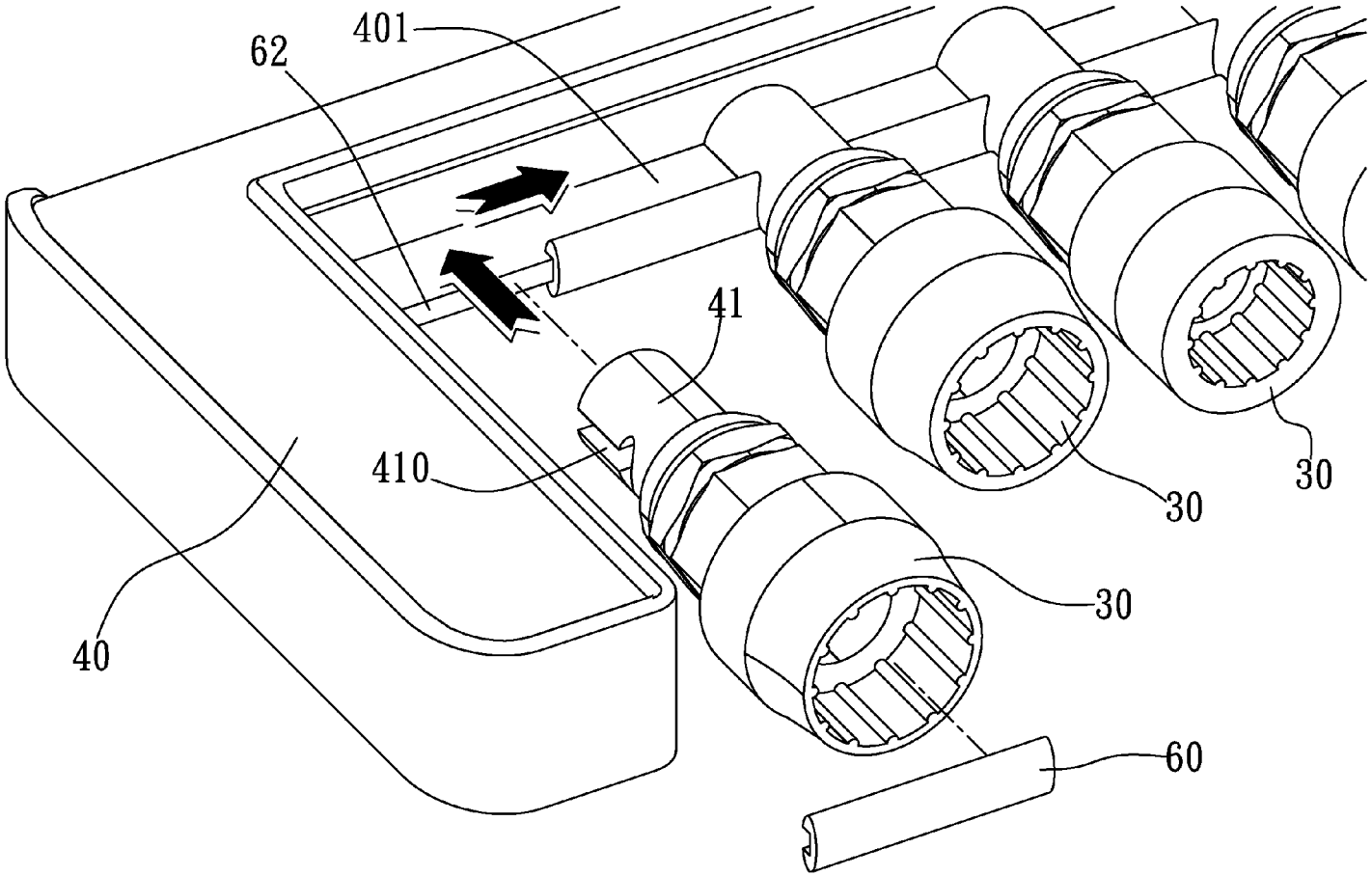
FIG. 6 is a schematic assembly view of the second embodiment of this invention.

Refer to FIG. 6 as a schematic assembly view illustrating a sleeve hanging device in the second embodiment of this invention, in which the joint part 41 wedges and glides into the track 401 from the notch 62.

In this invention, the amount of joint parts 41 provided along the track 401 is not limited, which depends upon a real condition and the length of track 401. In more detail, the track 401 of the tool fitting holder body 40 is a T-shaped cross section. One end of the track 401 is sealed. The other end of track 401 is formed with a notch 62 that is an I-shaped cross section. The upper end of joint part 41 is formed with a slot 410 having a T-shaped slot wall. The slot 410 wedges and glides into the inside of track 401 from the notch 62 of the track 401, as shown in FIG. 6. Further, after the joint parts 41 are wedged into the notch 62 on the track 401 in order, a sealing part 60 according to this invention may be used to seal the notch 62. In this embodiment, the sealing part 60 is a panel. When the sealing part 60 is wedged into the notch 62, a T-shaped cross section is formed and then the track 401 is formed, the notch 62 being thereby sealed.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A burglarproof tool fitting holder device, being used for a single-piece tool fitting, which has a joint end, and comprising:

a tool fitting holder body, of which the lower portion is formed with a joint part, wherein the joint part by the way of overlap connects to the joint end of the tool fitting;

a fixture unit, being provided at the lower portion of the body to fasten the tool fitting and comprising:

a fixing cover plate, being at one side of the joint part; and a fixing pedestal, being provided at the other side of the joint part and being opposite to the fixing cover plate, provided with a fixing space, in which the fixing pedestal combines with the fixing cover plate at the two sides of the tool fitting to fasten the tool fitting, a rib is formed in the fixing space opposite an inner fringe of the fixing cover plate, and when the fixing cover plate combines with the fixing pedestal, the rib is wedged into the inside of a groove on the side of the tool fitting;

wherein double effects of tool fitting hanging and protection against burglars being thereby attained, wherein at least one ear is formed at each of the two sides of the fixing cover plate to combine with two sides of the fixing pedestal, and wherein an elastic wedge is formed at each of the two sides of the fixing pedestal, the two sides being respectively opposite to the ears, when the fixing cover plate combines with the fixing pedestal, the elastic wedges are respectively inserted into the opposite ears.

2. The burglarproof tool fitting holder device according to claim 1, wherein the fixing space is a concave.

3. The burglarproof tool fitting holder device according to claim 1, wherein a rib is formed in the fixing cover plate opposite the fringe of the fixing space, wherein the rib embedded inside the groove on the side of the tool fitting when the fixing cover plate combines with the fixing pedestal.

4. The burglarproof tool fitting holder device according to claim 1, wherein the fixing cover plate is combined with the tool fitting holder body in one unit.

* * * * *